US007012185B2

(12) United States Patent
Holm et al.

(10) Patent No.: US 7,012,185 B2
(45) Date of Patent: Mar. 14, 2006

(54) METHODS AND APPARATUS FOR COMBINING PROCESSING POWER OF MIDI-ENABLED MOBILE STATIONS TO INCREASE POLYPHONY

(75) Inventors: Jukka Holm, Tampere (FI); Pauli Laine, Espoo (FI); Kai Havukainen, Tampere (FI)

(73) Assignee: Nokia Corporation, Espoo (FI)

( * ) Notice: Subject to any disclaimer, the term of this patent is extended or adjusted under 35 U.S.C. 154(b) by 253 days.

(21) Appl. No.: 10/360,216

(22) Filed: Feb. 7, 2003

(65) Prior Publication Data

US 2004/0159219 A1 Aug. 19, 2004

(51) Int. Cl.
*G10H 7/00* (2006.01)

(52) U.S. Cl. ..... 84/645

(58) Field of Classification Search ..... 84/645
See application file for complete search history.

(56) References Cited

U.S. PATENT DOCUMENTS

| | | | | |
|---|---|---|---|---|
| 5,300,725 | A | 4/1994 | Manabe | 84/609 |
| 5,652,400 | A * | 7/1997 | Fujimori et al. | 84/600 |
| 5,977,468 | A | 11/1999 | Fujii | 84/609 |
| 6,342,666 | B1 | 1/2002 | Shutoh | 84/645 |
| 6,806,412 | B1 * | 10/2004 | Fay | 84/645 |
| 2004/0154460 | A1 * | 8/2004 | Virolainen et al. | 84/645 |
| 2004/0159219 | A1 | 8/2004 | Holm et al. | 84/645 |

OTHER PUBLICATIONS

Lazzaro et al. "The MIDI Wire Protocol Packetization (MWPP)", www.ietf.org/internet-drafts/draft-ietf-avt-mwpp-midi-rtp-05.txt Jan. 29, 2003.
Lazzaro et al., "A Case for Network Musical Performance", NOSSDAV'01, Jun. 25-26, 2001.
"Scalable Polyphony MIDI Device 5-24 Note Profile for 3GPP", The MIDI Manufactures Association, Nov. 29, 2001.
"Scalable Polyphony MIDI Specification", The MIDI Manufactures Association, Nov. 29, 2001.

(Continued)

*Primary Examiner*—Jeffrey W Donels
(74) *Attorney, Agent, or Firm*—Harrington & Smith, LLP

(57) ABSTRACT

A method for playing music having i note polyphony, as well as a system containing a plurality of sources and a source itself, with at least two sources of a group of sources, where a first source is assigned to play j notes and a second source is assigned to play k notes, where j<i and k<i, and where the notes are assigned in a predetermined order. For a case where j+k<i, the methods further includes assigning a third source l additional notes to play of the musical composition. For a case where j+k_i, the l notes may duplicate all or some of the j or k notes played by the first or second sources. The j and k notes are played simultaneously, and the method further includes an initial step of synchronizing the first source to the second source through a wireless local network such as an RF network, e.g., a Bluetooth network, or an optical network. Preferably one of the at least two sources functions as a group master, and assigns an identification within the group to the other source or sources using the wireless local network.

27 Claims, 5 Drawing Sheets

OTHER PUBLICATIONS

MMidi: The MBONE Midi Tool, "Synchronizing Digital Music in a Multicast Network", 1996 Multimedia Networks Group, 3 pages.

"RTP: A Transport Protocol for Real-Time Applications", H. Schulzrinne et al., Jan. 1996, pp. 1-71, http://www.ietf.org/rfc/rfc1889.txt.

"RTP Payload Formats to Enable Multiple Selective Retransmissions", A. Miyazaki et al., May 2002, pp. 1-24, http://search.ietf.org/internet-drafts/draft-ietf-avt-rtp-selret-03.txt.

"RTP retransmission framework", David Leon et al., Nov. 2001, pp. 1-7, http://search.ietf.org/internet-drafts/draft-leon-rtp-retransmission-01.txt.

"Extended RTP Profile for RTCP-based Feedback (RTP/AVPF)", Stephan Wenger et al., Nov. 21, 2001, pp. 1-38, http://search.ietf.org/internet-drafts/draft-ietf-avt-rtcp-feedback-01.txt.

* cited by examiner

METHODS AND APPARATUS FOR COMBINING PROCESSING POWER OF MIDI-ENABLED MOBILE STATIONS TO INCREASE POLYPHONY

TECHNICAL FIELD

The field of the invention is that of combining the processing power of and synchronizing a plurality of simple computing and communications devices, such as cellular telephones, to increase the polyphony of a song being played or other sound generation. In particular, these teachings relate to techniques for musical compositions and to wireless communications systems and methods.

BACKGROUND

A standard protocol for the storage and transmission of sound information is the MIDI (Musical Instrument Digital Interface) system, specified by MIDI Manufacturers Association. The invention is discussed in the context of MIDI for convenience because that is a well known, commercially available standard. Other standards could be used instead, and the invention is not confined to MIDI.

The information exchanged between two MIDI devices is musical in nature. MIDI information informs a music synthesizer, in a most basic mode, when to start and stop playing a specific note. Other information includes, e.g. the volume and modulation of the note, if any. MIDI information can also be more hardware specific. It can inform a synthesizer to change sounds, master volume, modulation devices, and how to receive information. MIDI information can also be used to indicate the starting and stopping points of a song or the metric position within a song. Other applications include using the interface between computers and synthesizers to edit and store sound information for the synthesizer on the computer.

The basis for MIDI communication is the byte, and each MIDI command has a specific byte sequence. The first byte of the MIDI command is the status byte, which informs the MIDI device of the function to perform. Encoded in the status byte is the MIDI channel. MIDI operates on 16 different channels, numbered 1 through 16. MIDI units operate to accept or ignore a status byte depending on what channel the unit is set to receive. Only the status byte has the MIDI channel number encoded, and all other bytes are assumed to be on the channel indicated by the status byte until another status byte is received.

A Network Musical Performance (NMP) occurs when a group of musicians, located at different physical locations, interact over a network to perform as they would if located in the same room. Reference in this regard can be had to a publication entitled "A Case for Network Musical Performance", J. Lazzaro and J. Wawrzynek, NOSSDAV<01, Jun. 25–26, 2001, Port Jefferson, N.Y., USA. These authors describe the use of a client/server architecture employing the IETF Real Time Protocol (RTP) to exchange audio streams by packet transmissions over a network. Related to this publication is another publication: "The MIDI Wire Protocol Packetization (MWPP)", also by J. Lazzaro and J. Wawrzynek, http://www.ietf.org/internet-drafts/draft-ietf-avt-mwpp-midi-rtp-02.txt, Internet Draft, Feb. 28, 2002 (expires Aug. 28, 2002).

General MIDI (GM) is a wide spread specification family intended primarily for consumer quality synthesizers and sound cards. Currently there exist two specifications: GM 1.0, "General MIDI Level 1.0", MIDI Manufacturers Association, 1996, and GM 2.0, "General MIDI Level 2.0", MIDI Manufacturers Association, 1999. Unfortunately, these specifications require the use of high polyphony (24 and 32), as well as strenuous sound bank requirements, making them less than optimum for use in low cost cellular telephones and other mobile stations.

In order to overcome these problems, the MIDI Manufacturers Association has established a Scalable MIDI working group that has formulated a specification, referred to as SP-MIDI, that has become an international third generation (3G) standard for mobile communications. In order to have the most accurate references, this application will quote from the specification from time to time. SP-MIDI's polyphony and sound bank implementations are scalable, which makes the format better suited for use in mobile phones, PDAs and other similar devices. Reference with regard to SP-MIDI can be found at www.midi.org., more specifically in a document entitled Scalable Polyphony MIDI Specification, The MIDI Manufacturers Association, Los Angeles, Calif., and in a document entitled Scalable Polyphony MIDI Specification and Device Profiles which is incorporated by reference herein.

As wireless telecommunications systems and terminals evolve it has become desirable to provide high quality audio applications that run in this environment. Examples of applications are in providing users an ability to listen to high quality music, as well as high quality sound generation, such as musical ringing tones for telephones.

SUMMARY OF THE INVENTION

The foregoing and other problems are overcome, and other advantages are realized, in accordance with the presently preferred embodiments of these teachings.

A method is herewith provided to allocate and partition the computational load of software synthesis between two or more sources.

The teachings of this invention provide an entertainment application utilizing software synthesis and, preferably, the SP-MIDI or a similar standard. The use of SP-MIDI is not required, and is used as an example for convenience. Other protocols or standards could also be used. By the use of this invention one is enabled to combine the sound processing power of two or more sources in order to increase the polyphony of a song being played. The sources are assumed to be synchronized to one another using, for example, a low power RF interface such as Bluetooth, and the sources play the same MIDI file according to specified rules, preferably rules specified by SP-MIDI or some other MIDI-related protocol. MIDI is referred to for convenience because that is a well known, commercially available standard. Other standards could be used instead, and the invention is not confined to MIDI.

Disclosed is a method for playing music, as well as a system containing a plurality of sources and a source itself. The method includes providing a MIDI musical composition having i note polyphony and playing the musical composition with at least two sources of a set of sources, where a first source is assigned to play j notes and a second source is assigned to play k notes, where $j<i$ and $k<i$, and where the notes are assigned in a Channel Priority Order. For a case where $j+k<i$, the methods further includes assigning a third source l additional notes to play of the musical composition. For a case where $j+k=i$, the l notes may duplicate all or some of the j or k notes played by the first or second sources.

The j and k notes are played simultaneously, and the method further includes an initial step of synchronizing the first source to the second source through a cable or wireless local network such as an RF network, e.g., a Bluetooth network, or an optical network.

Preferably one of the two sources functions as a group master, and assigns an identification within the group to the other source or sources, using the wireless local network.

BRIEF DESCRIPTION OF THE DRAWINGS

The foregoing and other aspects of these teachings are made more evident in the following Detailed Description of the Preferred Embodiments, when read in conjunction with the attached Drawing Figures, wherein.

DETAILED DESCRIPTION OF THE PREFERRED EMBODIMENTS

Figure 1:
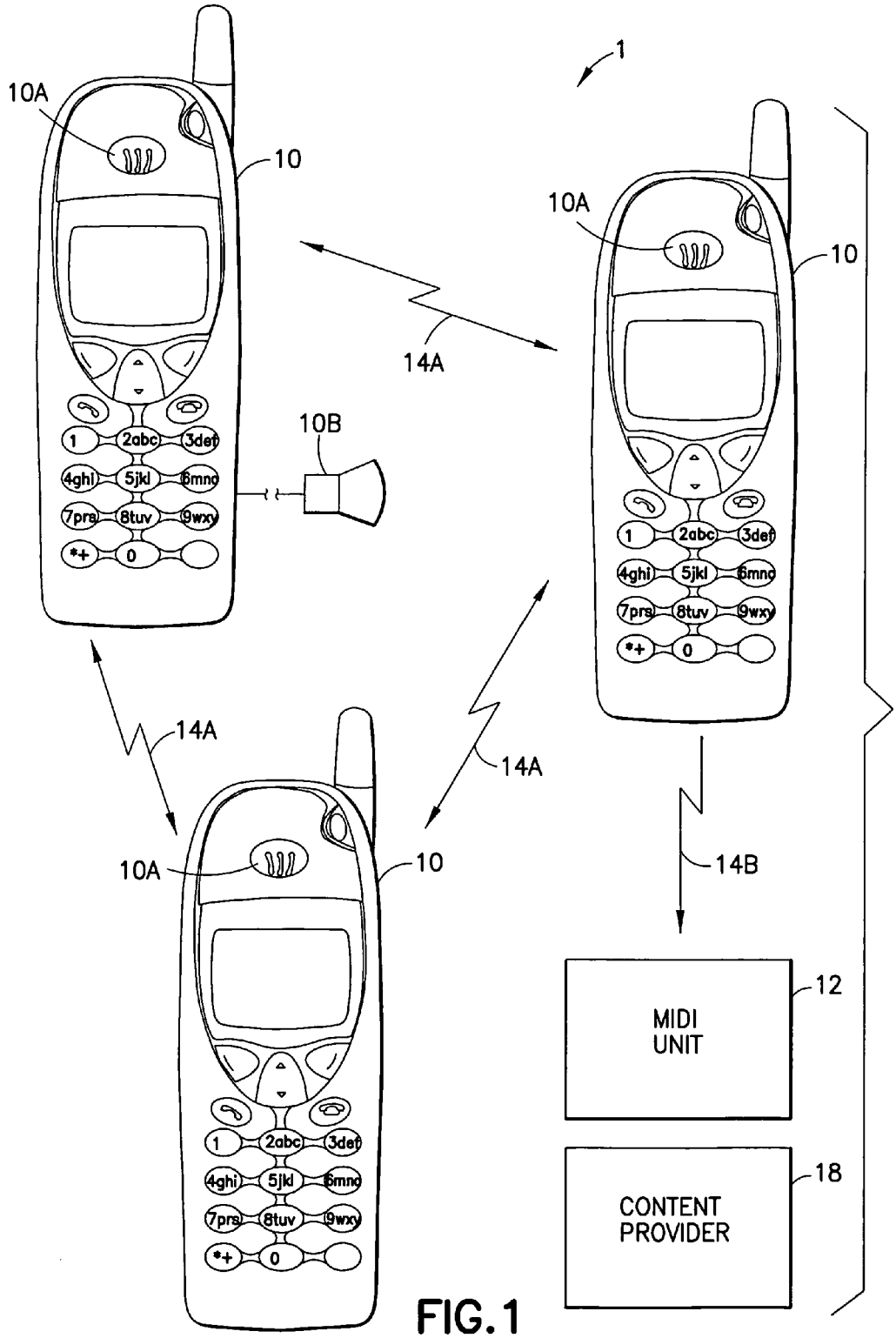
FIG. 1 is a high level block diagram showing a wireless communication network comprised of a plurality of MIDI devices, such as one or more sources and one or more MIDI units, such as a synthesizer.

FIG. 1 shows a wireless communication network 1 that includes a plurality of MIDI devices, such as one or more mobile telephone apparatus (handsets) 10, one or MIDI units 12. The MIDI unit 12 could be or could contain a music synthesizer, a computer, or any device that has MIDI capability. Illustratively, handsets 10 will contain a chip that performs the tasks of synthesis and associated software. The sources 10 could include headphones (not shown), but preferably for a group playing session as envisioned herein a speaker, such as the internal speaker 10A or an external speaker 10B, is used for playing music. Wireless links 14 are assumed to exist between the MIDI devices, and may include one or more bi-directional (two way) links 14A and one or more uni-directional (one way) links 14B. The wireless links 14 could be low power RF links (e.g., those provided by Bluetooth hardware), or they could be IR links provided by suitable LEDs and corresponding detectors. Box 18, labeled Content Provider, represents a source of MIDI files to be processed by the inventive system. Files may be transferred through any convenient method, e.g. over the Internet, over the telephone system, through floppy disks, CDs, etc. In one particular application, the data could be transmitted in real time over the internet and played as it is received. One station could receive the file and transmit it, in whole or just the relevant parts, over the wireless link or the phone system to the others. Alternatively, the file could be received at any convenient time and stored in one or more stations.

The above mentioned SP-MIDI specification presents a music data format for the flexible presentation of MIDI for a wide range of playback devices. The specification is directed primarily at mobile phones, PDAs, palm-top computers and other personal appliances that operate in an environment where users can create, purchase and exchange MIDI music with devices that have diverse MIDI playback capabilities.

SP-MIDI describes a minimum required sound set, sound locations, percussion note mapping, controller usage, etc., thereby defining a given set of capabilities expected of an SP-MIDI-compatible synthesizer. In general, SP-MIDI provides a standardized solution for scalable playback and exchange of MIDI content. The Scalable Polyphony MIDI Device 5–24 Note Profile for 3 GPP defines requirements for devices capable of playing 5–24 voices simultaneously (5–24 polyphony devices).

Figure 5:
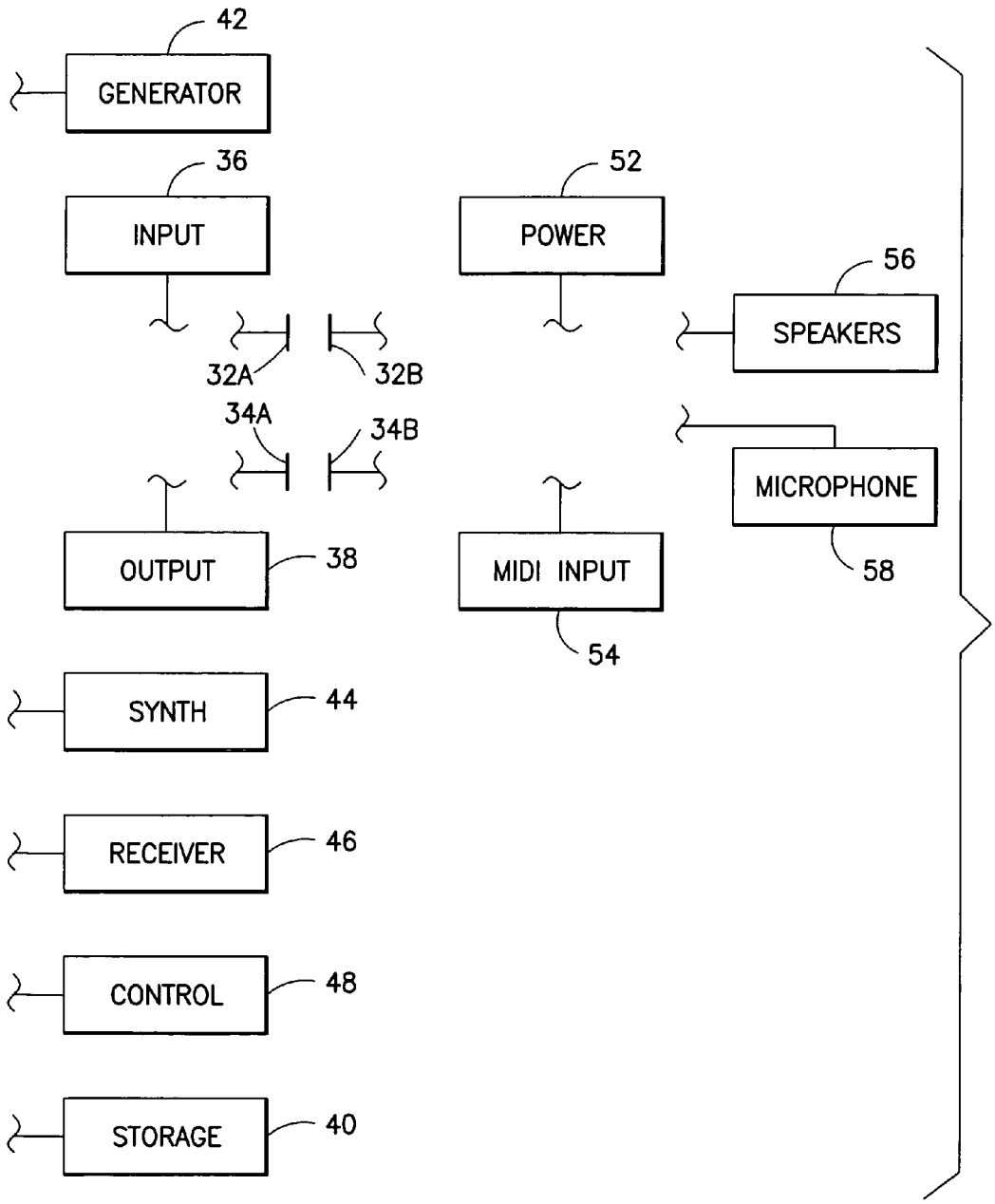
FIG. 5 shows a block level diagram of a mobile station.

Referring now to FIG. 5, there is shown a block diagram level representation of a station according to the invention. On the right, units exterior to the station are displayed-speakers 56, microphone 58, power supply (or batteries) 52 and MIDI input device 54. The power supply may be connected only to the external speakers 56, to the other exterior units, or to the station itself. The MIDI input device may be a keyboard, drum machine, etc. On the left of the Figure, a line of boxes represent various functions and the hardware and/or software to implement them. In the center, connectors 32A and -B and 34A and -B represent any suitable connector for a microphone-earpiece headset that may be used in the invention to connect a standard mobile station to external devices without adding an additional connector. At the bottom left, Storage 40 represents memory, floppy disks, hard disks, etc. for storing data. Control 48 represents a general purpose CPU, micro-controller, etc. for operating the various components according to the invention. Receiver 40 represents various devices for receiving signals—the local RF link discussed above, telephone signals from the local phone company, signal packets from the Internet, etc. Synthesizer 44 represents a MIDI or other synthesizer. Output 38 represents switches (mechanical or solid state) to connect various units to the output connector(s). Similarly, Input 36 represents switches (mechanical or solid state) to connect various units to the input connector(s) as well as analog to digital converters to convert microphone input to signals compatible with the system, as described below. Generator 42 represents devices to generate signals to be processed by the system; e.g. a) an accelerometer to be used to convert shaking motions by the user to signals that can control the synthesizer to produce maraca or other percussion sounds, or b) the keypad of the mobile station. Those skilled in the art will be aware that there is flexibility in block diagram representation and one physical unit may perform more than one of the functions listed above; or a function may be performed by more than one unit cooperating.

SP-MIDI

Before describing this invention in further detail, a more thorough discussion of certain aspects of SP-MIDI that are of most concern to this invention will first be made.

One aspect of SP-MIDI that pertains to this invention is referred to as channel masking. Consider a situation where a synthesizer plays a MIDI file that has a higher polyphony requirement (i.e., a higher maximum number of simultaneous playable notes) than the synthesizer can support. As the synthesizer is not capable of simultaneously playing all of the notes, the music playback may be partially randomized in prior practice, depending on a note stealing method used by the synthesizer manufacturer.

An important goal of polyphony scalability is to avoid this randomization of music playback. If all the notes on a particular MIDI channel cannot be played, an SP-MIDI synthesizer instead masks that channel, i.e., it ignores all notes on that particular channel.

Channel priorities are used to determine the MIDI channel masking order. In SP-MIDI, the content creator defines the priority order of the channels, and the priorities can be subsequently revised during playback.

For example, the composer can place the most important material in channels having the highest priority and the remainder of the playback material in lower priority channels.

This ensures that the most important instruments are played, even with low-polyphony playback devices that are not capable of playing all of the channels.

Based on the foregoing discussion, it may be appreciated that an SP-MIDI playback device is required to have some knowledge of MIDI channel polyphonies and priorities in order to be able to define the channels that it is capable of playing. For this purpose an SP-MIDI-specific MIDI message is used. This message is referred to herein as a Maximum Instantaneous Polyphony (MIP) message. The MIP message data is used to inform the synthesizer in a source 10 or the MIDI unit 12 of the polyphonies required for different MIDI Channel combinations within the MIDI file. The MIP may be considered as a cumulative polyphony of all 16 MIDI Channels. The order of the MIDI channel combinations is determined by the above-mentioned Channel Priority list.

A purpose of SP-MIDI is to offer the composer enhanced control over the playback of the music on various platforms. The composer is then enabled to freely decide how different SP-MIDI synthesizers should react to the content. Using the MIP message it is possible to incorporate multiple versions of the same high-polyphony piece of music within the same SP-MIDI file. Each SP-MIDInn synthesizer plays only those parts in (or layers of) a song that the composer has defined to be optimal for that polyphony. As an example, the composer can make a three-layer 24-polyphony SP-MIDI file that can be played on SP-MIDI8, SP-MIDI16, and SP-MIDI24 (SP-MIDI 8-polyphony, SP-MIDI 16-polyphony, SP-MIDI 24-polyphony) synthesizers, with different sets of instrumental sounds to produce a pleasing composition in each synthesizer. Thus, one would have 8-, 16- and 24-note arrangements with layers 1–8, 9–16 and 17–24.

As a specific example, the composer could choose alto and tenor saxophones, two trumpets, snare and bass drums, cymbals and bass for the 8-polyphony synthesizer, thus having a first set of MIDI instructions giving a first part of the composition (the melody, say), to the saxophones and trumpets, so that the music is played in the minimum case on a first apparatus comprising the 8-polyphony synthesizer. The composer would provide an option for adding a piano part (with up to four polyphony, say) and a guitar part (also with up to four polyphony) for the 16-polyphony case. The composer would have to make a design choice whether to merely add subordinate parts for the 16-polyphony case, or to give the piano some of the more important music (i.e. to provide different saxophone, trumpet and other melody parts for the 8-polyphony and 16-polyphony cases). Thus, a piece of music to be played according to the invention might include an 8-polyphony version having a first saxophone part and a 16-polyphony version having a different saxophone part, etc. for the other instruments that normally play the melody. The term "part", as used herein, means the music for an instrument of a particular type, e.g. the saxophone part for a saxophone section of up to n saxophones. The term "portion" as applied to music means the melody, rhythm, etc. Thus, in a more complex system according to the invention, a second set of instructions allocates some of the melody portion of the music to a second set of instrumental voices (saxophone, trumpet and piano). Similarly, the rhythm portion of the music can have versions for a limited number of voices and for a larger number.

In addition to polyphony, the SP-MIDI standard is also defined to be scalable. The SP-MIDI specification introduces a minimum required sound set, although manufacturers may expand the minimum sound set up to, for example, a full General MIDI 2.0 sound set. Any required instruments that are not available are patched such that a most similar-sounding of the available instruments is played instead. In this way none of the specified musical elements are neglected due to a lack of instrument support by the playback system.

In SP-MIDI, each of the MIDI channels 10 and 11 can be used as rhythm channels. If there were only one available rhythm channel then the creation of scalable and good sounding musical content would become very difficult as the polyphony rises. Each MIDI channel, apart from channel 10, can be used as a melody channel.

The teachings of this section provide an entertainment application that utilizes software synthesis in the context of the SP-MIDI standard. In this invention the sound processing power of two or more sources 10 is combined in order to increase the polyphony of a song being played. The sources are synchronized to one another using, some suitable wireless communication link, a LAN or the phone network. The wireless communication link may be a low power, short-range RF link (e.g., Bluetooth), or it may be an IR optical link. The synchronized sources 10 play different portions of the same MIDI file according to rules specified by SP-MIDI. Each source 10 may have a different set of sounds (instruments) all of which are assumed to adhere to the SP-MIDI specification. Both polyphony and the quantity of available sounds are therefore summed together.

In the typical case each SP-MIDInn synthesizer plays only those parts of a song that the composer has defined to be optimal for that polyphony. In one example, a composer might create a three-part, 24-polyphony SP-MIDI file that can be played on SP-MIDI8, SP-MIDI16 and SP-MIDI24 synthesizers. An individual terminal may, if it has enough memory, store the whole composition. Alternatively, it may receive only the data that it will be playing.

In accordance with an aspect of this invention, the 24 notes of this example are partitioned between the available sources 10. If there are, for example, two sources 10 available that have SP-MIDI8 capability, the first SP-MIDI8 source plays the first eight notes according to the Channel Priority Order, and the second SP-MIDI8 source plays the next eight notes. If a third source 10 later joins the group of two sources, it is assigned to play the remainder of the 24 notes. Thus the full 24 note composition can be played, even though not one of the participating sources has a synthesizer capable of playing more than eight notes.

The teachings of this invention thus provide for grouping several devices together to create a musical sound environment that is common to all the devices. Each source 10 and/or MIDI device 12 is assumed to have at least one (internal or external) speaker. The source(s) 10 and/or MIDI device(s) 12 are preferably located in the same space so that every user hears the sound output from all of the devices. Each device is given a unique ID for differentiating that device from other devices in the group of devices, thereby providing the ability to inform the devices as to which layers of the SP-MIDI file they should play.

By the use of this invention the sounds of multiple MIDI devices are combined into one shared sound environment. The use of this invention relieves the high computational requirements of software synthesis by partitioning the processing load between at least two SP-MIDI-compatible sources 10 and/or MIDI devices 12. Both the polyphony and the quantity of available sounds are therefore summed together.

The use of this invention automatically allocates different MIDI channels between the sources 10 and/or MIDI devices 12. Furthermore, a separate controlling host operation is not required, as embedded decentralized control is provided by the participating sources 10 and/or MIDI devices 12 and their communication over the local area wireless network that is implemented using Bluetooth or some other suitable technique. The actual sound output is generated through each source 10 speaker 10A, though a common mixer and speakers could also be used.

The teachings of this invention solve the problem of the high computational requirements of software synthesis by splitting the processing load between two or more sources 10. This enables higher polyphony music to be played and enjoyed in a group situation. The actual sound is improved and additional voices are enabled to be heard. The addition of devices with enhanced sound banks further improves the sound. Certain instruments can be multiplied by playing them with more than one source 10.

The MIDI-related services can be downloaded to users over the air, and basic ringing tone MIDI files and the like can be used so that additional effort by content creators may not be required.

Before the playback can begin, the sources 10 are synchronized to each other by using, for example, Bluetooth. Preferably, the synchronization continues through the playing. If the sources 10 have timing that is sufficiently good, the synchronization information could be sent only at the beginning of playing. When several devices are used to create the shared sound environment, each of them is uniquely identified in order to be able to resolve which device plays which SP-MIDI layer. It is possible to implement the process to be totally automatic or user controllable.

Figure 2:
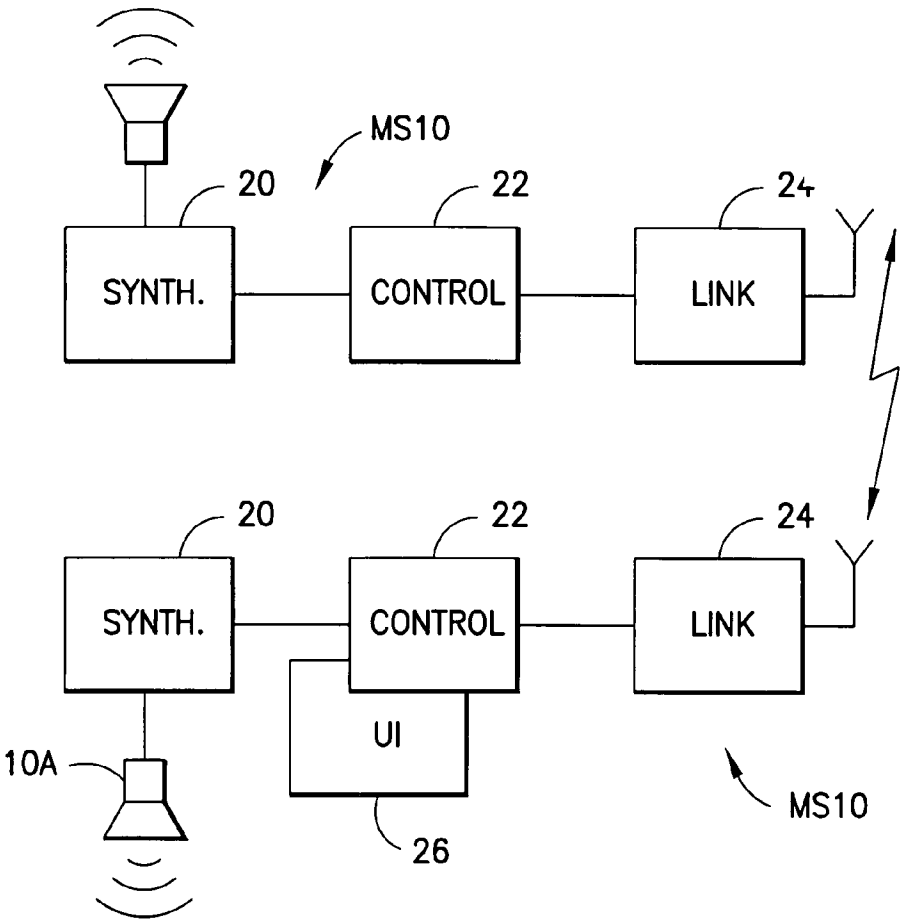
FIG. 2 is a simplified block diagram in accordance with this invention showing two of the sources from FIG. 1 that are MIDI enabled.

Discussing first the totally automatic mode, heuristics implemented in the system select which parts of the music, sometimes referred to as layers, are played by which synthesizer. Referring to FIG. 2, it can be seen that each source 10 includes a synthesizer 20 coupled with a controller 22 (which may be a general purpose or special purpose computer) that operates in accordance with this invention, and that receives information from at least one other controller 22 via a wireless link 24, such as Bluetooth. This is done automatically after the shared sound playing is enabled in the source 10, and another SP-MIDI-enabled source 10 is detected in the immediate environment.

In the user controllable mode, a relatively simple user interface (UI) 26 is provided for enabling the selection of which channels are played by which source 10. One alternative is that one source 10 of the group assumes the role of a master device, and sets the IDs for each device as they join the group. The ID numbers can be assigned in order of joining the group, or at random, and they determine which MIDI channels (i.e. which SP-MIDI layer or musical part) the device should play.

Figure 3:
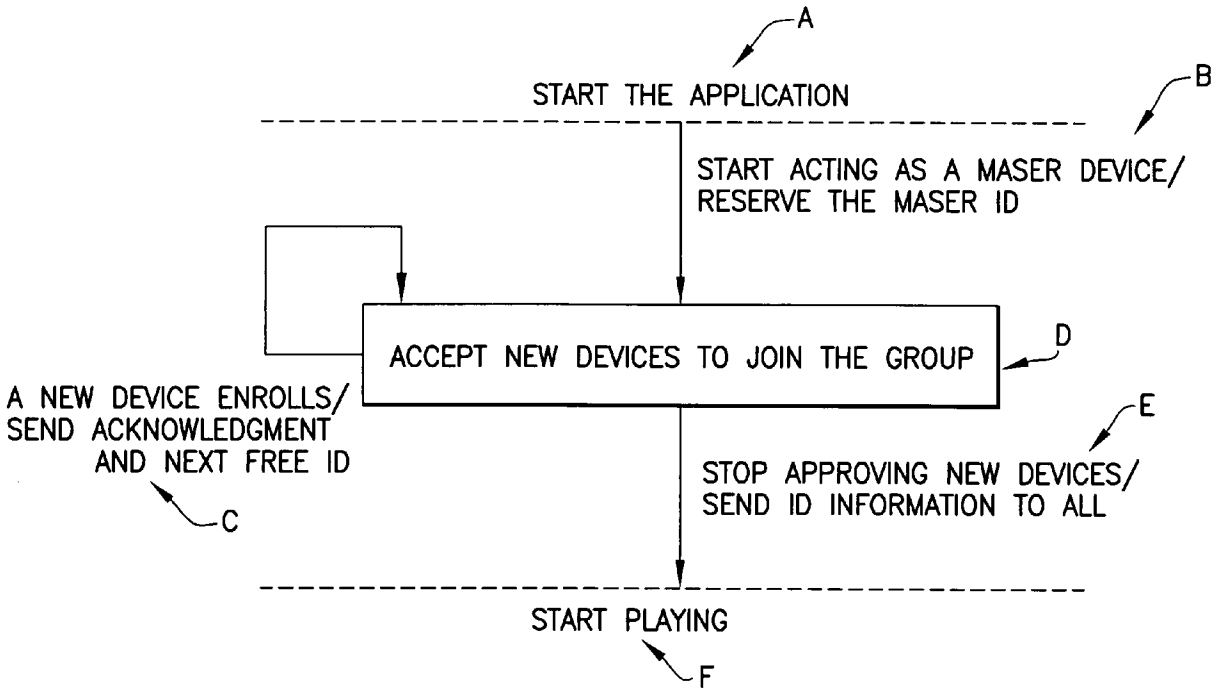
FIG. 3 is an exemplary state diagram illustrating the setting of IDs when one device acts as a master device.
Figure 4:
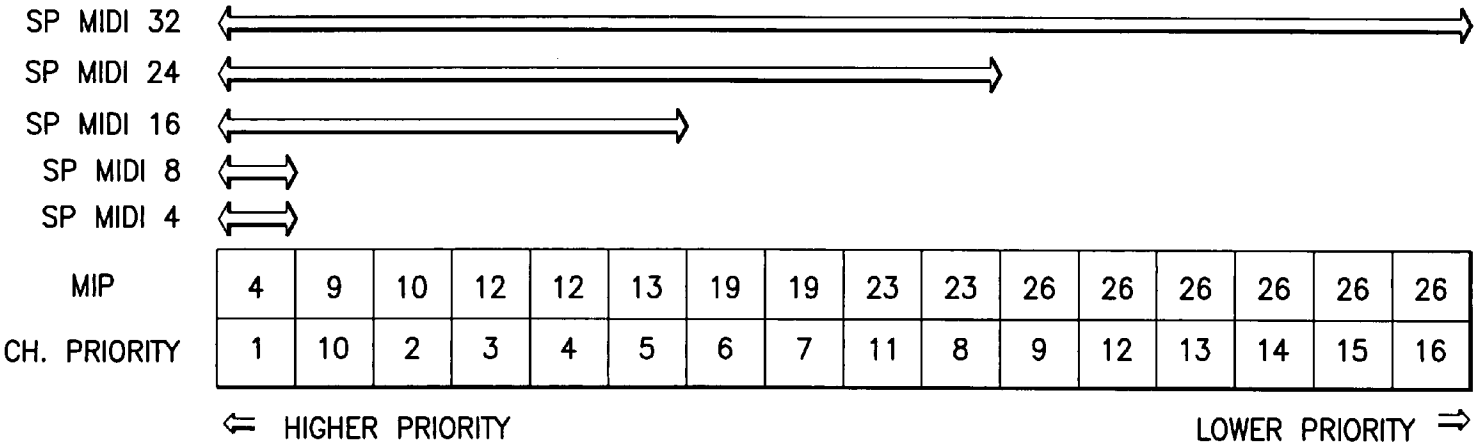
FIG. 4 shows an example of how SP-MIDI synthesizers with different polyphony capabilities (SP-MIDInn) select which MIDI channels to play. A number of the highest priority MIDI channels are selected according to the corresponding MIP values.

FIG. 3 shows an example of starting an application and assigning the IDs to various one of the sources 10 of the group. At Step A the application is begun, and at Step B one of the sources 10 assumes the role of the master device and reserves a master device ID. As examples, this source 10 could be the first one to join the group, or one selected by the users through the UI 26. As other sources 10 enter the space occupied by the group (e.g., a space defined by the reliable transmission range of the wireless link 24, that is also small enough for the sound from all devices to be heard by all participating sources 10) the new device attempts to enroll or register with the group (Step C). If accepted by the master device an acknowledgment is sent, as well as the new sourcc=s MIDI group ID (Step D). At some point, if playing has not yet begun, the group is declared to be full or complete (Step E), and at Step F the group begins playing the music, where each source 10 plays only its assigned layer. The end result is a substantial increase in polyphony without a corresponding increase in computational load and power consumption for any one particular source.

If there are more willing participants than there are available SP-MIDI layers, some layers can be assigned to two or more sources 10.

While described in the context of certain presently preferred embodiments, the teachings in accordance with this invention are not limited to only these embodiments. For example, the wireless connection between terminals 10 can be any suitable type of low latency RF or optical connection (wireless or cable) so long as it exhibits the bandwidth required to convey messages between the participating sources. Further in this regard the link could be made through any suitable connection, including the Internet.

What is claimed is:

1. A method for playing music, comprising:

providing a musical composition having i note polyphony; and playing the musical composition with at least two sources of a group of sources, where a first source is assigned to play j notes and a second source is assigned to play k notes, where $j<i$ and $k<i$ and the total polyphony played by the at least two sources in combination is greater than both j and k, and where the notes are assigned according to prioritized channels, each channel representing an instrumental voice.

2. A method as in claim 1, where the k notes duplicate some of the j notes assigned to the first source.

3. A method as in claim 1, where $j+k<i$, and further comprising assigning a third source l additional notes to play of the musical composition, and the total polyphony played by the at least three sources in combination is further greater than l.

4. A method as in claim 1, where $j+k=i$, and further comprising assigning a third source l notes to play the musical composition, where the l notes duplicate all or some of the j or k notes played by the first or second sources.

5. A method as in claim 1, where the j and k notes are played simultaneously, and further comprising an initial step of synchronizing the first source to the second source.

6. A method as in claim 1, where the j and k notes are played simultaneously, and further comprising an initial step of synchronizing the first source to the second source by communications made through a wireless local network.

7. A method as in claim 6, where the wireless local network comprises an RF network.

8. A method as in claim 7, where the RF network comprises a Bluetooth network.

9. A method as in claim 6, where the wireless local network comprises an optical network.

10. A method as in claim 1, where one of the at least two sources functions as a group master, and assigns an identification within the group to the other source or sources.

11. A method as in claim 6, where one of the at least two sources functions as a group master, and assigns an identification within the group to the other source or sources using said wireless local network.

12. A system comprising a group of sources coupled together through a local wireless network, said system being responsive to a presence of a musical composition having i note polyphony for partitioning the musical composition such that it is played by at least two sources of the group, said system including a controller that operates to assign, according to prioritized channels that each represent an instrumental voice, a first source to play j notes on a first set of at least one channel and a second source to play k notes on a second set of at least one channel, where $j<i$ and $k<i$.

13. A system as in claim 12, where the k notes duplicate some or all of the j notes assigned to the first source and the first and second sets of channels are not identical.

14. A system as in claim 12, where $j+k<i$, wherein the controller further operates to assign a third source to play l additional notes of the musical composition.

15. A system as in claim 12, where $j+k=i$, wherein the controller further operates to assign a third source to play l notes of the musical composition, where the l notes duplicate all or some of the j or k notes assigned to the first or second sources.

16. A system as in claim 12, where the j and k notes are played simultaneously, and further comprising means for synchronizing the first source to the second source through said wireless local network.

17. A system as in claim 12, where said wireless local network comprises an RF network.

18. A system as in claim 17, where said RF network comprises a Bluetooth network.

19. A system as in claim 12, where said wireless local network comprises an optical network.

20. A system as in claim 12, where one of the at least two sources functions as a group master for assigning an identification within the group to the other source or sources using said wireless local network.

21. A source, comprising a wireless transceiver coupled to a controller and a synthesizer that has an output coupled to a speaker, said controller being responsive to a composition having n note polyphony for controlling said synthesizer for playing, in wireless synchronism with at least one other source, m notes of the composition, where $m<n$, and where said at least one other source plays additional notes of the composition.

22. A source as in claim 21, where said wireless transceiver comprises a Bluetooth transceiver.

23. The method of claim 1, wherein the prioritized channels are channels of a Channel Priority Order of a published MIDI specification.

24. The system of claim 12, wherein prioritized channels are channels of a Channel Priority Order of a published MIDI specification.

25. The system of claim 12, wherein the total polyphony played by the group of sources in combination is greater than a polyphony played by any source of the group.

26. An article of manufacture comprising a computer-readable storage medium for storing a program, executable by a processor, for performing actions directed toward synchronously playing an audio file, the actions comprising:

assigning a host device to play an audio file of i-polyphony using a first set of channels exhibiting j polyphony, wherein $j<i$; and assigning a second device to synchronously play the audio file using a second set of channels exhibiting k polyphony, wherein $k<i$;

wherein the first and second sets of channels each comprise at least one channel that is not within the other of the first and second sets.

27. The article of manufacture of claim 26, wherein the host device comprises a mobile station and assigning is over a wireless link.

* * * * *